US007350389B2

(12) United States Patent
Reissenweber et al.

(10) Patent No.: US 7,350,389 B2
(45) Date of Patent: Apr. 1, 2008

(54) METHOD AND DEVICE FOR RESHAPING A WORK PIECE WITH AUTOMATIC HANDLING

(75) Inventors: Frank Reissenweber, Sesslach (DE); Harald Barnickel, Niederfüllbach (DE); Lothar Bauersachs, Weidhausen (DE)

(73) Assignee: Langenstein & Schemann GmbH, Coburg (DE)

( * ) Notice: Subject to any disclaimer, the term of this patent is extended or adjusted under 35 U.S.C. 154(b) by 12 days.

(21) Appl. No.: 10/559,046

(22) PCT Filed: May 28, 2004

(86) PCT No.: PCT/EP2004/005782

§ 371 (c)(1),
(2), (4) Date: Nov. 30, 2005

(87) PCT Pub. No.: WO2004/108323

PCT Pub. Date: Dec. 16, 2004

(65) Prior Publication Data

US 2006/0123871 A1 Jun. 15, 2006

(30) Foreign Application Priority Data

Jun. 6, 2003 (DE) ..... 103 26 105
Jul. 23, 2003 (DE) ..... 103 33 394

(51) Int. Cl.
*B21D 11/22* (2006.01)
*B21D 43/10* (2006.01)
*B21J 13/10* (2006.01)

(52) U.S. Cl. ..... 72/305; 72/311; 72/361; 72/422

(58) Field of Classification Search ..... 72/305, 72/306, 296–298, 311, 361, 405.01, 405.09, 72/405.12, 405.13, 422; 29/34 R
See application file for complete search history.

(56) References Cited

U.S. PATENT DOCUMENTS 3,128,817 A * 4/1964 Shaver ..... 72/13.8

(Continued)

FOREIGN PATENT DOCUMENTS

DE 2554277 A1 6/1977

(Continued)

OTHER PUBLICATIONS

German Article from Schmiede Journal of Mar. 2002, pp. 42-43, including English abstract, by Peter Kuhn and Hermann Loser.

*Primary Examiner*—Daniel C Crane
(74) *Attorney, Agent, or Firm*—Workman Nydegger

(57) ABSTRACT

Aspects of the present invention relate to an automated handling device for handling a forged piece during a forging press. A method in accordance with an implementation of the present invention involves positioning the workpiece between two tools in a predetermined shaping position in at least one working region of a shaping machine (positioning step), particularly one that operates percussively, moving the tools of the shaping machine relative to one another and shaping the workpiece between the tools during at least one shaping step, holding the workpiece in its shaping position by at least two handling devices during each shaping step, and thus also when the tool(s) strike the workpiece, and automatically controlling or regulating by mutual coordination the motions and positions of at least two handling devices by use of at least one control device.

58 Claims, 6 Drawing Sheets

U.S. PATENT DOCUMENTS

| | | | | | |
|---|---|---|---|---|---|
| 3,874,048 | A | * | 4/1975 | Millar et al. | 29/33 K |
| 4,227,394 | A | | 10/1980 | Heimel | |
| 4,449,390 | A | | 5/1984 | Pontini | |
| 5,206,036 | A | * | 4/1993 | Medwin | 425/327 |
| 5,852,945 | A | * | 12/1998 | Burger | 72/306 |

FOREIGN PATENT DOCUMENTS

| | | | |
|---|---|---|---|
| DE | 2832987 | A1 | 4/1979 |
| DE | 3148652 | A1 | 9/1982 |
| DE | 3422810 | A1 | 1/1986 |
| DE | 4220796 | A1 | 1/1994 |
| DE | 4444495 | A1 | 6/1995 |
| DE | 10060709 | A1 | 6/2002 |
| JP | 05277612 | A | 5/1988 |
| JP | 63123546 | A | 10/1993 |

* cited by examiner

METHOD AND DEVICE FOR RESHAPING A WORK PIECE WITH AUTOMATIC HANDLING

This application is a 371 of PCT/EP04/05782, filed May 28, 2004.

BACKGROUND OF THE INVENTION

1. Field of the Invention

The invention relates to a method and a device for shaping a workpiece.

2. Background and Related Art

Shaping machines, especially of the percussive type, such as hammers, crank presses, and screw presses, in particular flywheel screw presses, are known for industrial forging of workpieces. Percussive shaping machines comprise a working region in which two tools are movable, generally in a straight line, relative to one another. The workpiece is positioned between the two tools, and is then shaped by the impact force or impact energy from the striking of the tools on the workpiece and the resulting shaping energy.

According to VDI-Lexikon "Produktionstechnik Verfahrenstechnik" [Manufacturing Process Engineering], Prof. Dr. Hiersig, Publisher, VDI-Verlag, 1995, pages 1107-1113, forging hammers may be subdivided into anvil hammers—which in turn are subdivided into drop hammers and double-acting hammers—and counterblow hammers. An anvil hammer comprises an anvil (or support) as a tool that is stationary with respect to the workpiece, and a striking hammer, or hammer for short, as a tool that is movable, generally vertically, with respect to the workpiece and to the anvil. A counterblow hammer comprises two striking hammers that are movable, vertically or also horizontally, with respect to one another and relative to the base or the hammer frame. The drives for the hammers of forging hammers are generally hydraulic or pneumatic. In the actual shaping or work procedure, both the hammer frame and the hammer drives of a forging hammer are relieved of the shaping force so as not to overload the forging hammer. For screw presses, the workpiece that is moved is generally referred to as a tappet. The tappet is moved by a spindle in a straight line toward the stationary tool. The drive of the spindle, and thus of the tappet, is provided by a drive motor and/or a flywheel as an energy store (VDI-Lexikon, see above).

The shaping pressure force and the shaping temperature are dependent on the material of which the workpiece is composed, as well as the requirements for dimensional accuracy and surface quality. In principle, forgeable workpieces include all ductile metals and metal alloys, and therefore also ferrous materials such as steels, as well as nonferrous metals such as aluminum, titanium, copper, nickel, and alloys thereof. The temperatures arising during forging may be in the range of room temperature for so-called cold shaping, between 550° C. and 750° C. for warm shaping, and above 900° C. for so-called hot shaping. The shaping temperature is also typically set in a temperature range in which the material is shapeable or flowable and in which recovery and recrystallization processes in the material can take place, and also in which undesired phase transformations are avoided.

For automatic handling of workpieces during pressing or forging, the use of handling devices such as manipulators and industrial robots is known from VDI-Lexikon "Produktionstechnik Verfahrenstechnik", Prof. Dr. Hiersig, Publisher, VDI-Verlag, 1995, pages 848, 849, and 1214. Such handling devices have grippers for grasping and temporarily holding workpieces, and insert the workpieces into or remove them from the forging machine. Manipulators are manually controlled motion devices which as a rule have distinct, process-specific controls or programs. Industrial robots are universally applicable automatic motion devices with a sufficient number of degrees of freedom, implemented by a corresponding number (5 to 6) axes of motion, and a freely programmable control for achieving practically any given motion trajectories of the workpiece within an area which the industrial robot can traverse or reach.

One problem with the use of such handling devices is the high impact forces from a percussive shaping machine, which during the shaping impact can impose significant stress and cause damage to the handling device when the handling device is holding the workpiece which is struck by the hammer or tappet.

BRIEF SUMMARY OF THE INVENTION

The object of the invention, therefore, is to propose a method and a device for shaping workpieces by which the referenced disadvantages may be at least partially overcome. It is an also an object to enable rapid setup of the machine, in particular after tool replacement or tool remachining, while at the same time ensuring a high degree of process reliability.

To solve the problem of the reaction to the impact of the hammer or tappet of the shaping machine, DE 42 20 796 A1 and DE 100 60 709 A1 have proposed handling devices which can be flexibly positioned during the impact to damp the impact forces and vibrations transmitted from the workpiece to the drive, and which can be rigidly positioned during transport of the workpiece.

DE 42 20 796 A1 discloses a handling device for holding a forged piece during a forging process, in which a traveling mechanism carries a gripping mechanism via a sleeve, the gripping mechanism having vise-grip pincers that grip the forged piece during the forging process. The sleeve may be optionally brought into a flexible state and a rigid state by hydraulic means.

A handling device, designed as a manipulator or robot, for handling a forged piece during a forging press is known from DE 100 60 709 A, having a gripping jaw and a gripping arm which supports the gripping jaw. The gripping arm is connected via a flexible block piece, made of an elastically deformable material, to an arm region which by means of a first electromotor may be pivoted up and down, and by means of a second electromotor, raised and lowered. These two motions of the arm region are synchronized by a control device. Due to the flexibility of the block piece, the front region of the gripper comprising the gripping arm and gripping jaw is pivotable in the block piece with respect to the rear region comprising the arm region and the drive motors, as a type of articulating joint. If the gripper now places a forged workpiece on a forging die of a forging hammer, and the striking tool strikes the workpiece from above, vibrations or impacts thus produced may become damped and absorbed in the elastic block piece, thereby relieving the load on the drives. For handling the workpiece before or after the actual shaping process in the forging hammer, the elastic block piece is bridged by a rigid control rod which produces a rigid connection between the gripper arm and the arm region via the block piece. The rigid control rod is fixed in place when the front gripper arm and the rear arm region are in the parallel position, and when the workpiece is lying on the forging die of the forging hammer the rigid control rod can be released by raising the rear arm region.

Workpieces that tend to buckle, in particular elongated workpieces, are problematic for automated forging processes according to the prior art. Because of their motor sensitivity and experience, during the forging process human operators are able to compensate for or prevent buckling of the workpiece by handling, although they are holding the workpiece only on one side. In contrast, the known handling devices do not permit automated forging in which the workpiece can reliably be prevented from buckling.

Lastly, there is an additional problem in the handling of forged parts, in that the forged parts may sometimes have significant deviations in shape, particularly at the ends which are grasped by the handling devices, due to manufacturing or processing tolerances in previous shaping or reshaping steps. For this reason, significant deviations in the position of the forged part relative to the handling device, and thus relative to the tool of the shaping machine as well, may result during gripping with the known automatic gripping mechanisms, which may lead to a high reject rate and, in extreme cases, even to damage of the tools.

It would now be possible to detect the position of the workpiece in the tool of the shaping machine, for example by image analysis, and to correspondingly control the handling device to correct a deviation in the position of the workpiece from a target position relative to the tool. However, this is quite costly, and in practice functioning systems are not yet available.

Because of the referenced problems, automated handling of workpieces in forging processes with percussive shaping machines has not yet achieved widespread acceptance in actual practice. Instead, in practice the workpiece is still manually held in the forging hammer using a gripping tool, since appropriately trained operators control the correct handling of the workpiece when it is struck by the hammer along with the striking tool.

The object of the present invention is to partially alleviate or totally avoid the aforementioned problems of the prior art. This object is achieved according to the invention by a method having the features of claim 1, and a device having the features of claim 40.

The method according to the invention is suitable for shaping, in particular forging, at least one workpiece, and specifies and comprises the following process steps:

a) Positioning the workpiece between two tools in a predetermined or predeterminable shaping position in at least one working region of a shaping machine (positioning step), particularly one that operates percussively,
b) Moving the tools of the shaping machine relative to one another and shaping the workpiece between the tools during at least one shaping step,
c) Holding the workpiece in its shaping position by at least two handling devices during each shaping step, and thus also when the tool(s) strike the workpiece, and
d) Automatically controlling or regulating by mutual coordination the motions and positions of at least two handling devices by use of at least one control device.

The device according to the invention is suitable for shaping at least one workpiece, and in particular for use in a method according to the invention, or for carrying out a method according to the invention, and specifies and comprises the following:

a) At least one shaping machine, particularly one that operates percussively, having at least two tools that are moveable with respect to one another for shaping a workpiece in a predetermined or predeterminable shaping position during at least one shaping step,
b) At least two handling devices for holding the workpiece in the shaping position during the shaping step, and
c) At least one control device for controlling or regulating the motions and positions of the handling devices.

The motion of the tools relative to one another in the shaping machine naturally also includes the case that only one of the two tools moves relative to the floor or machine frame or some other external reference system, and the other tool remains stationary with respect to this external system, for example for a double-acting hammer or drop hammer, or a screw press, as well as the case that both tools move relative to the external reference system, for a counterblow hammer, for example. The shaping position of the workpiece refers to its absolute and adjustable geometric position in space relative to an external coordinate system. A change in the shaping position generally consists of translatory and/or rotational changes in position or motion; i.e., the workpiece may be displaced and/or rotated. The working region of the shaping machine(s) is the area between the tools in which the actual shaping takes place. Multiple working regions may also be formed between two tools, which for example may be defined by various gravures in a forging die. For controlling the handling devices, the motion proceeds according to a predetermined or predeterminable motion sequence or motion profile, or a correspondingly stored control program (no feedback or "open-loop control"), whereas for regulation, the motions of the handling devices are metrologically measured and adjusted to predetermined target motions (reference input variables for the motion) or regulated (feedback or "open-loop control"). The term "automatic" means that at least during the shaping step itself it is no longer necessary to manually intervene or hold the workpiece, since this is automatically performed by the handling devices (or robotic motion devices) by controlling the control device. The motions or positions of the handling devices are coordinated with one another to enable precise handling of the workpiece, in particular to enable the workpiece to be fixed in the shaping position when struck in the shaping machine. Thus, there is no kinematic coupling between the two handling devices when the workpiece is handled during shaping.

The present invention is based on the concept that the workpiece is secured or held by gripping in at least two locations by a respective handling device, at least when struck by the tool(s), in particular striking tool(s), of the shaping machine during the shaping step.

This has the primary advantage that the workpiece is fixed at two locations when struck by the tool(s), and therefore can be more reliably kept from breaking out or sliding out from the tools.

A further advantage is that buckling of a long workpiece on one side can be prevented, since the handling devices are able to fix the workpiece on both sides and stabilize it during shaping.

One particular advantage of the invention is the possibility of compensating for a deviation in the position of the workpiece relative to the tools as a result of a corresponding deviation of the shape of the workpiece in a region in which a first of the handling devices engages. This is accomplished by using the second handling device to grip and secure the workpiece in a second region. The workpiece is brought into a sort of center position between the two handling devices by the measures according to the invention, whereas when grasped by only handling device, such as with the handling devices of the prior art, the workpiece is displaced or twisted on account of the tolerances. This problem of preproduction tolerances is irrelevant for manual handling of the workpiece, since a human operator easily corrects a deviation in the position of the workpiece and correctly inserts it. Thus, automatic correction of the position of the workpiece by use of automated image analysis to determine the position of the workpiece is not necessary according to the invention. In the invention, deviations are corrected mechanically, so to speak, by the fact that both handling devices constrain the workpiece in the target position by fixing or grasping it at two locations, optionally with corresponding deformation of the workpiece.

Advantageous embodiments and refinements of the method and the device for shaping a workpiece according to the invention are disclosed or otherwise recited in the specification and claims herein.

The kinematic coupling of the handling devices may be achieved by mechanical means, but preferably is implemented electronically or by using control or regulation devices by coupling with the actuation of the drive systems of the handling devices.

In addition to securely holding the workpiece during shaping, the handling devices may also perform other handling functions, in particular one or more of the following:

- Ventilating the workpiece immediately after the shaping blow or impact
- Transferring the workpiece from one working region of a shaping machine to the next, or from one gravure of a tool to the next, or from one shaping position to the next
- Rotating or swiveling the workpiece, in particular to change a shaping position
- Regripping the workpiece to account for its change in shape after a shaping step
- Receiving the workpiece from a pickup device
- Conveying the workpiece to or from the shaping machine, in particular to a deposit station.

In one advantageous embodiment, for at least a portion of the handling of the workpiece by two handling devices, both handling devices are moved synchronously and/or along trajectories essentially at a constant distance with respect to one another, and/or essentially at the same speed.

The control device controls or regulates both handling devices, in particular the respective drive mechanisms thereof, in one embodiment according to a master-slave control principle, in which a handling device acting as the slave follows the motions of a handling device acting as the master.

In an alternative preferred embodiment, the control device controls both handling devices, in particular the drive mechanisms thereof, independently of one another, in mutually adapted control sequences.

In general, during a motion and/or handling of the workpiece each handling device or its contact point on the workpiece travels along a trajectory determined in advance with a predetermined speed characteristic, and/or follows stored successive trajectory points at regular time intervals.

The associated trajectory of the handling device or its contact point on the workpiece is preferably learned in advance, but may also be calculated or simulated.

In one special embodiment, the trajectory of one of at least two handling devices or their contact points on the workpiece are learned, and the trajectory of at least one additional handling device or its contact point on the workpiece is calculated in advance from the learned trajectory of the first handling device, and is stored or calculated in real time.

During training of the trajectory of a handling device or its contact point on the workpiece, in general the associated trajectory is traversed, and the trajectory points are successively determined and stored at regular time intervals. The speed characteristic during training is preferably specified according to the subsequent speed characteristic for the process. For any given speed characteristic during training, the actual speed characteristic during operation may also subsequently be taken into account, and new trajectory points may be calculated and stored. During movement and/or handling of the workpiece, the handling device or its contact point on the workpiece in each case follows the trajectory points stored during learning, optionally after speed correction, in the same time intervals and in the same sequence as during learning.

During handling actions at the shaping machine, the two handling devices preferably are situated on opposite sides of the working region or of the shaping machine tools. Furthermore, the handling devices may also preferably be moved into a parked position to make the working region(s) of the shaping machine(s) accessible.

In one advantageous embodiment of the device, each handling device has a) at least one gripping mechanism having at least two gripping elements that are movable relative to one another for gripping the workpiece,
b) at least one support apparatus to which the gripping mechanism is or may be fastened, and
c) at least one conveying device for conveying the support apparatus along with the gripping mechanism.

The device is now preferably refined by the fact that a flexible connection of the support apparatus and conveying device in a flexible state results in at least partial absorption or damping of impacts or vibrations that are transmitted from the workpiece in the shaping machine to the gripping devices during the shaping process, thereby protecting the conveying device from these mechanical stresses, and that, in contrast, a rigid connection or position of the support apparatus and conveying device in a rigid state is used when the workpiece is handled during transport, or during rotation or swiveling before or after shaping steps.

In one preferred application of the invention, a forging hammer or screw press is used as the shaping machine.

The invention is further explained below, with reference to exemplary embodiments. In this regard reference is made to the drawings, wherein

DETAILED DESCRIPTION OF THE PREFERRED EMBODIMENTS

Figure 1:
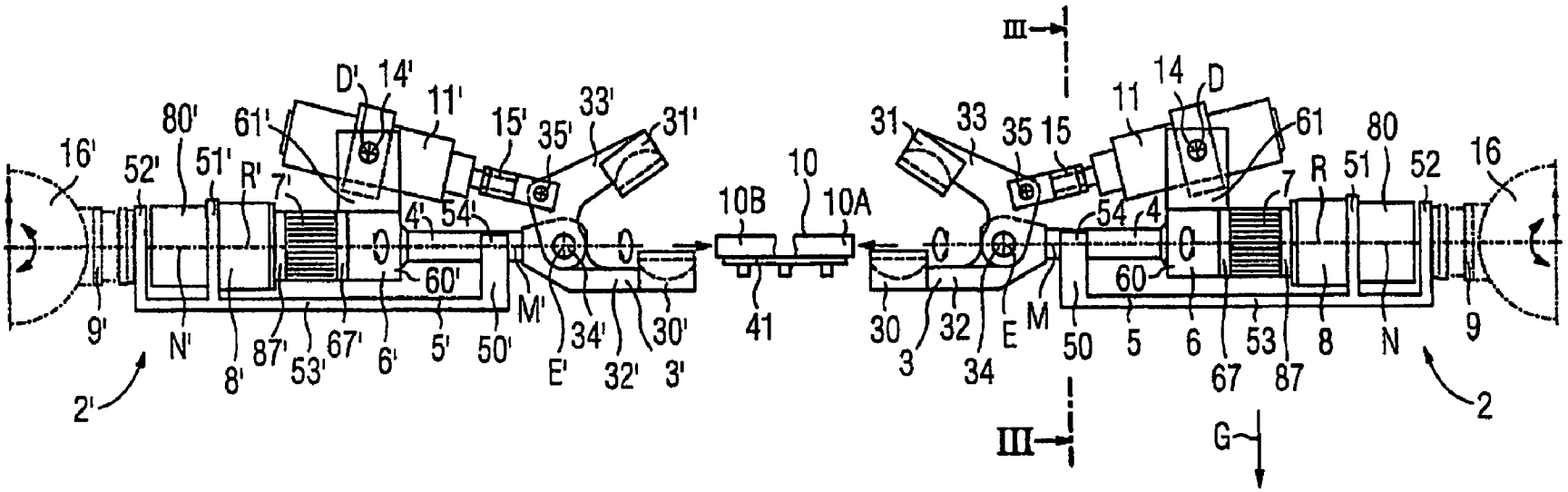
FIG. 1 shows a device having two handling devices for grasping a workpiece, in a side view.

A first handling device is designated by reference number 2, and a second handling device, by 2'. Each of the handling devices 2 and 2' may be designed as manipulators or robots. In the exemplary embodiments illustrated in FIGS. 1 through 5, both handling devices 2 and 2' have essentially the same design, each comprising a gripping mechanism (or gripping pincer) designated by 3 or 3', a support shaft by 4 or 4', a support device (or rigid control device) by 5 or 5', a bearing part by 6 or 6', a flexible element by 7 or 7', a pivot drive (or rotary drive) by 8 or 8', an articulated joint by 9 or 9', an actuating device by 11 or 11', and a conveying device by 16 or 16'.

Each gripping mechanism 3 or 3' comprises two gripping levers 32 and 33 or 32' and 33', each having an associated gripping jaw (or gripping element, pincer jaw) 30 and 31 or 30' and 31', which by means of the actuating device 11 or 11' are able to swivel with respect to one another about a swivel axis E or E' in a swivel bearing 34 or 34' for opening and closing the gripping mechanism 3 or 3'. The actuating device 11 or 11' engages the gripping lever 33 or 33' in an engagement bearing 35 or 35', and is mounted in a swivel bearing 14 or 14' so as allow swiveling about a swivel axis D or D' on a holding part 61 or 61' on the bearing part 6 or 6'.

The gripping lever 32 or 32' of the gripping mechanism 3 or 3' is coaxially connected via the support shaft 4 or 4' to an intermediate part 60 or 60' of the bearing part 6 or 6', along an axis M. The flexible element 7 or 7' is mounted between the intermediate part 60 or 60' and the rotary drive 8 or 8', which is connected to the articulated joint 9 or 9' along a second axis N. Each of the flexible elements 7 or 7' is connected via a flange 67 and 87 or 67' and 87' to the intermediate part 60 or 60' and the rotary drive 8 or 8', respectively, and is made of an elastic material, preferably an elastomer.

The front unit of the handling device 2 or 2', namely, the gripping mechanism 3 3', support shaft 4 or 4', and bearing part 6 or 6', in addition to the actuating device 11 or 11' on the one hand, and the rear unit of the handling device 2 or 2', namely, the rotary drive 8 or 8' and the articulated joint 9 or 9' in addition to the conveying device 16 or 16' on the other hand, and, therefore, also the axes M and N thereof, are able to swivel with respect to one another in the flexible element 7 or 7'.

Figure 3:
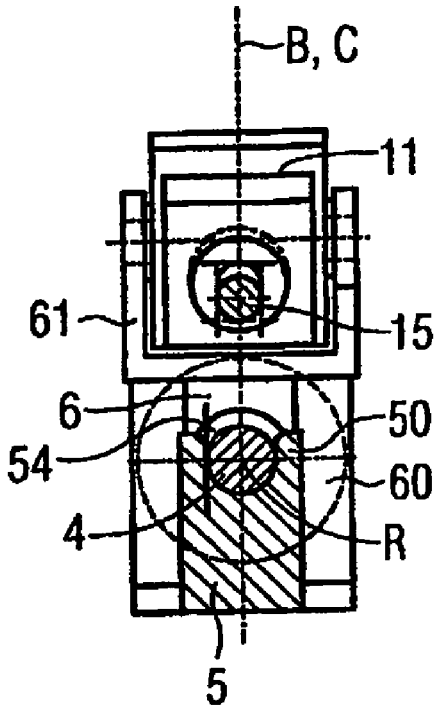
FIG. 3 shows a cross section through one of the handling devices according to FIG. 1, in the sectional plane described by III-III.
Figure 4:
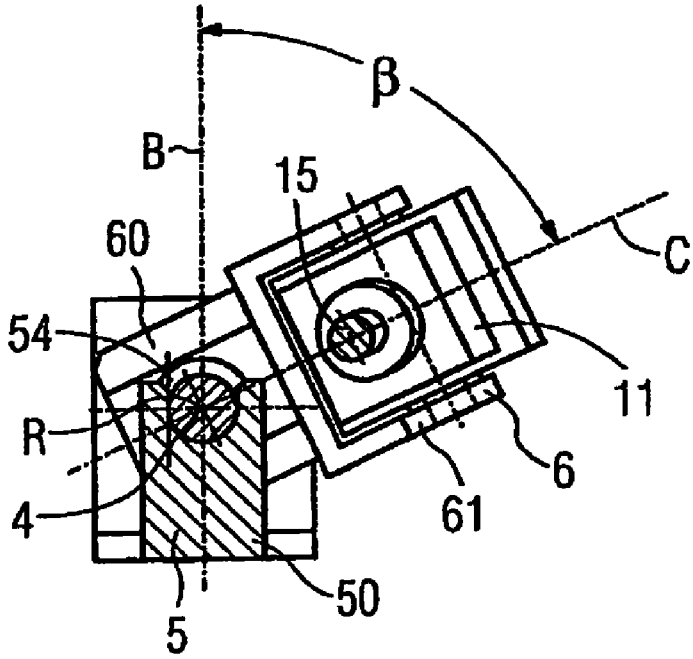
FIG. 4 shows a sectional view according to FIG. 3, with the gripping mechanism and actuating device swiveled.

FIGS. 3 and 4 show an exemplary embodiment for a swivel motion, in a sectional view through the lifting cylinder for the actuating device 11 and the support shaft 4, as well as the support part 50 of the handling device 2 according to FIG. 1.

FIG. 3 shows a vertical position in which a center axis B of the support part 50 of the support device 5 and a center axis C of the actuating device 11 and of the bearing part 6 coincide, and the actuating device 11 is thus positioned in the direction of the gravitational force G, seen from above the intermediate part 60 of the bearing part 6.

In FIG. 4, the front unit of the handling device 2 is now swiveled or rotated to the right, in the clockwise direction, about a swivel angle β. The support shaft 4 thereby rotates about the rotational axis R in its support bearing 54 in the support apparatus 5. The center axis C of the front unit, in particular of the bearing part 6 and actuating device 11, and thus the gripping mechanism 3 as well, are now swiveled relative to the center axis B of the support device 5, about the swivel angle β. In this manner a workpiece 10 may be rotated about the corresponding swivel angle β.

Figure 2:
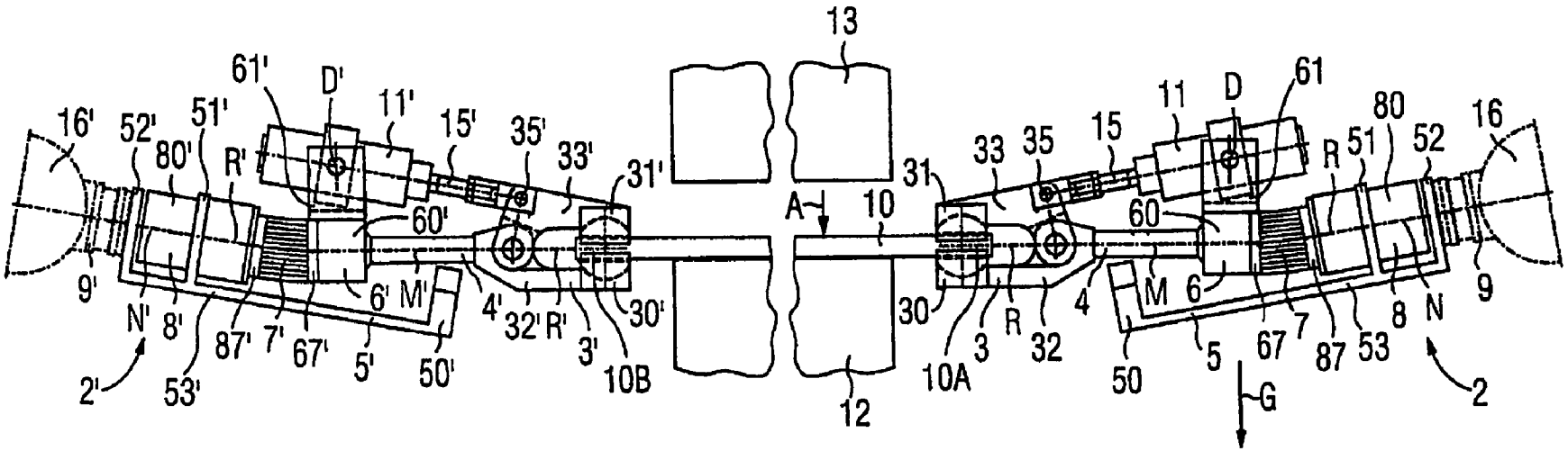
FIG. 2 shows the device according to FIG. 1, in which the two handling devices hold the workpiece placed in a shaping machine, in a side view.

The support device 5 or 5' for the handling devices 2 and 2' according to FIGS. 1 and 2 comprises a longitudinal connecting rod 53 or 53' on which are situated a first fastening part 51 or 51' extending transversely upward for connecting the connecting rod 53 or 53' to the rotary drive 8 or 8', and further to the rear, a second fastening part 52 or 52' extending transversely upward for connecting the connecting rod 53 or 53' to the articulated joint 9 or 9', and in the front region an upwardly projecting support part 50 or 50', transverse to the connecting rod 53 or 53', for fixing or supporting the support shaft 4 or 4'. The support part 50 or 50' has a recess as a support bearing (or shaft seat) 54 or 54' for the support shaft 4 or 4' (see FIGS. 3 and 4).

In the state shown in FIG. 1, the handling devices 2 and 2' are moved toward the workpiece 10 or 10' in the direction of the illustrated arrows, axes M and N running coaxially with respect to one another as well as horizontally, i.e., perpendicular to gravitational force G, and the flexible element 7 or 7' being essentially undeformed. The connecting rod 53 or 53' now runs parallel to the axes M and N, and the support part 50 or 50' supports the support shaft 4 or 4', and thus the gripping mechanism 3 or 3' connected thereto, in its support bearing 54 or 54'. The support device 5 or 5' thus represents a mechanical bridge over the flexible element 7 or 7', and in the position according to FIG. 1 removes the flexibility of the handling device 2 or 2' in the flexible element 7 or 7', at least in the direction of the gravitational force G, and in the downwardly directed, lateral directions between the gravitational force G and the horizontal direction. The rigid connection is maintained solely by the intrinsic weight of the parts of the handling device 2 or 2'. The gripping mechanisms 3 and 3' are in their vertical positions, and are open.

When they reach the workpiece 10 the gripping mechanisms 3 and 3' close, thereby grasping the workpiece 10 at its ends 10A and 10B. The workpiece is conveyed to a shaping machine by conveying devices 16 and 16', where it is placed on a tool in the shaping position for shaping. The handling device 2 or 2' is thereby held in the rigid state by the support device 5 or 5'.

FIG. 2 shows the workpiece 10 in the laid-out state on the lower tool or forging die 12 of a forging hammer. By raising the lower unit of the handling devices 2 and 2', i.e., by inclining the center axis N or N' of the rotary drive 8 or 8' and articulated joint 9 or 9' about the angle of inclination a relative to the center axis M or M' of the front unit about the flexible element 7 or 7', the support device 5 or 5' is disengaged from the support shaft 4 or 4', since the support device 5 or 5' together with the rotary drive 8 or 8' and articulated joint 9 or 9' remain aligned along the axis N or N', and the support part 50 or 50' therefore is at a sufficient distance from the support shaft 4 or 4'. During the inclined motion about angle α or α', the forging die 12 is used as an abutment via the workpiece 10.

The striking tool 13 on the striking mechanism of the forging hammer (not illustrated) now strikes the workpiece 10 in the impact direction A. Significant impact and vibrational stresses arise in the striking motion which are transmitted through the workpiece 10 to the handling devices 2 and 2'. However, the elastic elements 7 or 7' now largely decouple these impacts or vibrations from the conveying device 16 or 16' and rotary drive 8 or 8', thereby protecting these drive devices from overload. Depending on the workpiece 10 and the desired shaping process, however, in many shaping processes it may be necessary to rotate the workpiece 10, in particular about a rotational axis that extends through the workpiece 10, its longitudinal axis, for example, before placing it on the forging die 12. For such a rotational or swiveling motion, the gripping mechanisms 3 and 3' together with the grasped workpiece 10 in the supported state, i.e., in engagement with the support device 5 located in the support shaft 4, are swiveled about the desired rotational angle β in the same rotational direction and at the same rotational or angular velocity in order to rotate the workpiece into its desired shaping position without torsion. To this end, a rotational motion of a drive shaft of a drive motor, situated in the drive housing 80 or 80' of the rotary drive 8 or 8', or optionally via a transmission, is transmitted through the drive flange 87 or 87' and the flexible element 7 or 7' to the connecting flange 65 or 65', which in turn also rotates the intermediate part 60 or 60', support shaft 4 or 4', and gripping mechanism 3 or 3'. Such swiveling motions occur, for example, during bending of a workpiece in a first forging process or forging step, and subsequent flat shaping or forging. The rotatability of the gripping mechanisms 3 and 3' may be omitted if rotation is not desired.

Figure 5:
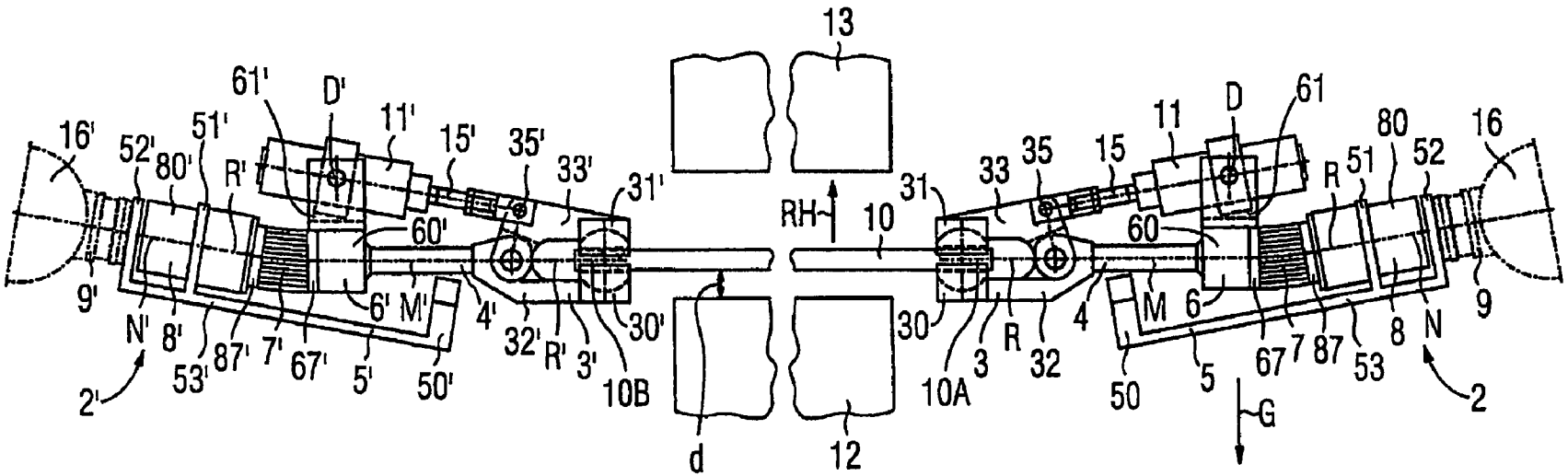
FIG. 5 shows the device according to FIG. 1 or FIG. 2, in which after the shaping impact the two handling devices ventilate the workpiece located in the shaping machine, in a side view.

Proceeding from FIG. 2, FIG. 5 shows the situation shortly after the striking tool 13 strikes the workpiece 10 and the surrounding regions of the tool 12. The striking tool 13 is again set in upward motion away from the tool 12 by the recoil or, optionally, by a drive, into a recovery position RH. The workpiece 10 is now lifted from the tool 12 by a distance d, or ventilated. This ventilating motion by the two handling devices 2 and 2' and the workpiece 10 held thereby follows the upwardly moving striking tool 13, in the same direction as the recovery direction RH. The handling devices 2 and 2' generally remain in the flexible position, as illustrated in FIG. 5. During or after this ventilating motion, scale material is blown out of the lower tool 12 by means of a blower. The ventilation also shortens the time that the workpiece 10 is in contact with the lower tool or forging die 12. After the ventilation procedure, the workpiece 10 may now either be placed on the tool 12 again, on another forging die, or on another gravure of the tool 12, and may be reshaped by the striking tool 13. However, the shaping process may also be ended and the workpiece 10 moved by the two handling devices 2 and 2', out of the ventilated position shown in FIG. 5 and out of the working region of the shaping machine, and conveyed to a depositing device.

Figure 6:
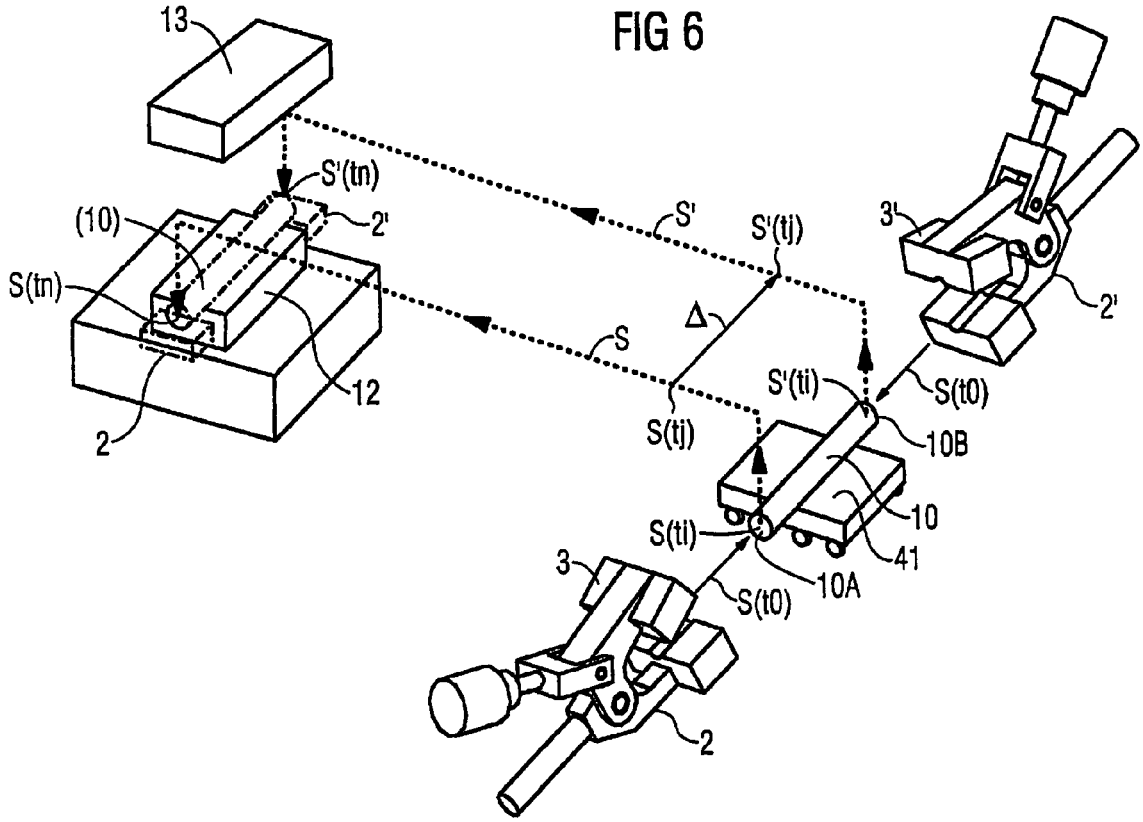
FIG. 6 shows a device for shaping a workpiece, having two handling devices which handle the workpiece along predetermined paths of motion, in a schematic perspective view.

FIG. 6 shows an exemplary embodiment for handling a workpiece 10 with two handling devices 2 and 2', starting with receiving at a pickup device 41 and eventually placing the workpiece on a tool 12 of a percussive shaping machine. The paths of motion or trajectories of the two handling devices 2 and 2' are designated by S and S', while the directions of motion are represented by arrows.

The two handling devices 2 and 2' are each started at time t0 from a parked or starting position S(t0) and S'(t0) and move toward the workpiece 10 on the pickup device 41. At time ti the handling devices 2 and 2' reach the respective ends 10A and 10B of the workpiece 10 at the respective positions S(ti) and S'(ti). The gripping mechanisms 3 and 3' now grasp the respective end 10A or 10B of the workpiece 10, and the handling devices 2 and 2' convey the workpiece 10 along trajectories S and S'. The two trajectories S and S' run parallel to one another, and the handling devices 2 and 2' are synchronously moved relative to one another. The motion of the workpiece 10 is therefore essentially only translational, and not rotational. The difference vector Δ=S'(tj)−S(tj) is thus always the same at any given time tj. At the end of the trajectories S and S' the handling devices 2 and 2' guide the workpiece 10 into the working region between the tools 12 and 13 of the percussive shaping machine, and move the workpiece 10 downward into a predetermined shaping position on the tool 12, in an end position S(tn) for handling device 2 and S'(tn) for handling device 2' at an end time tn, on opposite sides of the working region or tool 12 of the shaping machine. The workpiece 10, indicated by dashed-dotted lines, is now in the shaping position on the tool 12 and may be shaped.

During shaping, the handling devices 2 and 2', likewise indicated by dashed-dotted lines, once again hold the ends 10A and 10B of the workpiece 10. After the workpiece 10 is shaped by impacting or striking the striking tool 13 on the workpiece 10, a ventilating motion by the handling devices 2 and 2' may now proceed, as shown in FIG. 5. Furthermore, the workpiece 10 may additionally or alternatively be transferred from one gravure of the tool to another, or may also be conveyed from the shaping machine to a depositing or transporting device.

As a rule, tools 12 and 13 are shaping tools, so-called forging dies, having gravures correspondingly matched to the desired shape of the workpiece. The handling devices generally hold the workpiece 10 during the entire forging cycle, and jointly and synchronously perform all handling motions necessary for the forging process. Handling motions include, among others, ventilating motions inside a gravure, as well as transferring motions from the supply device to the first gravure of the forging die, transferring motions between gravures in the forging die, and transferring motions from a gravure in the forging die to a transporting device.

Furthermore, workpieces are preferably forged whose ends, which are held by the handling devices during handling, are not symmetrical with respect to the workpiece axis. These workpieces are stretched in previous work steps, thereby forming unsymmetrical workpiece ends. The workpiece 10 is automatically aligned by being grasped at both ends 10A and 10B by respective handling devices 2 and 2', and is thus placed precisely in its shaping position into the gravure or the tool 12.

The joint and synchronous travel of both handling devices 2 and 2' is achieved by an electronic coupling between the two handling devices 2 and 2', the coupling being made via the master-slave operation of electrical drives, or, alternatively, by simultaneously starting independently operating drives. The start signal for the individual handling steps is supplied by a control device which controls the sequence between the percussive shaping machine and the two handling devices 2 and 2'. This control device may also perform the entire signal exchange. As a rule, the control device operates with the assistance of at least one digital processor, in particular a microprocessor or digital signal processor, and corresponding memories in which the sequence programs, control algorithms, and data for the motions are stored. Master-slave control devices known as such may be used for a master-slave operation. For independently operating drives, identical distances and speeds as well as error feedback and error reactions are provided between the independently operating drives to ensure precise and, in the event of malfunctions, reliable operation.

In a typical forging cycle, a workpiece is supplied by means of a supply device or pickup device. Both handling devices 2 and 2' subsequently grip the workpiece 10 and jointly and synchronously place it into a gravure in the forging die of the percussive forging die shaping machine. The percussive forging die shaping machine is now actuated at a variable point in time during or at the end of the handling motion, and after striking is actuated the further handling of the workpiece is initiated at a variable point in time during or at the end of the striking motion. This further handling is once again performed jointly and synchronously by both handling devices 2 and 2', and may be a ventilation motion of the workpiece in the same gravure, a joint and synchronous transfer of the workpiece to another gravure, or the joint and synchronous transfer of the workpiece to a depositing device for the finished, shaped workpiece.

If the workpiece 10 is designed so that the first handling and forging steps can be performed by only one handling device, the second handling device 2' likewise grips the workpiece 10 at a later time in the forging cycle, and after this point in time both handling devices 2 and 2' perform forging jointly and synchronously, as already described. The partial transfer or forging with only one handling device is particularly meaningful when more than two handling devices are used, since in this manner the additional handling device(s) can pick up a new workpiece and optionally forge it while the other two handling devices finish forging the previous workpiece or place it in a transporting device. By use of this design, shorter cycle times may be achieved with at least three handling devices.

Figure 7:
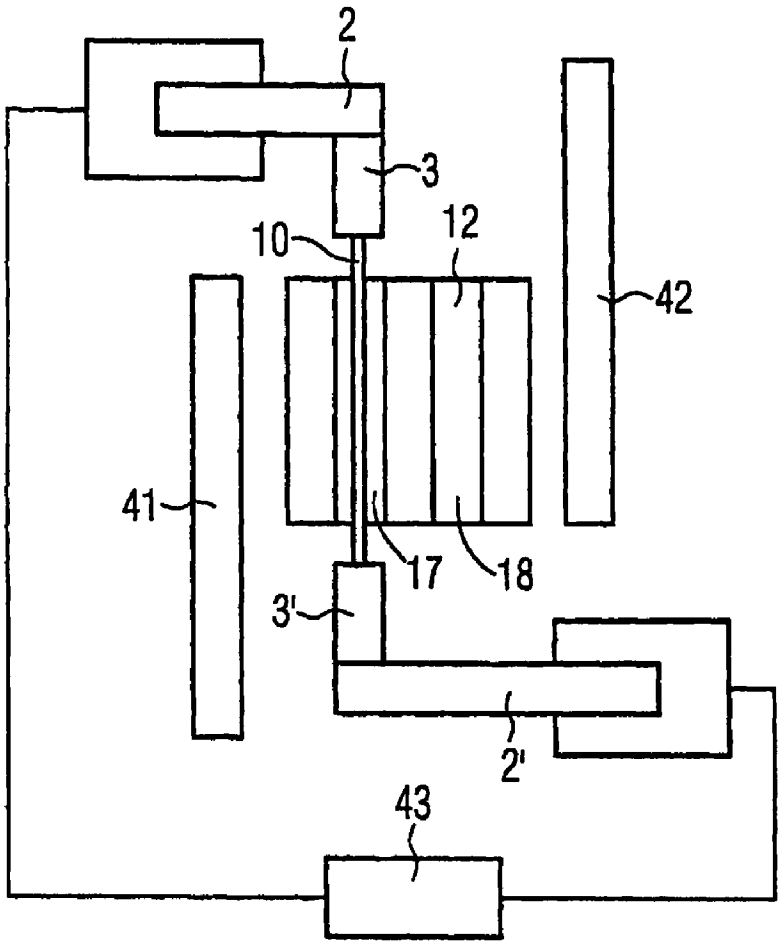
FIG. 7 shows a device for shaping a workpiece, having two handling devices, during handling of the workpiece, in a top view.

FIG. 7 shows a further exemplary embodiment of a device for handling a workpiece during a forging process. This device once again comprises two handling devices 2 and 2' with respective gripping mechanisms 3 and 3', schematically illustrated as industrial robots. The two handling devices 2 and 2' take a workpiece 10 from a pickup device 41, such as a feed conveyor belt or other automated supply device, for example, and place the workpiece in a first gravure 17 in a tool 12 of a percussive forging die shaping machine. The counter-tool or striking tool of this forging die shaping machine is not illustrated, but in the top view shown would be located above the plane of the drawing. During or at the end of the handling motion, or the transfer motion from the pickup device 41 to the first gravure 17 in the tool 12, the striking tool of the shaping machine is actuated. After the striking action has been actuated, a new sequence is initiated for further handling of the workpiece 10 at a time during or at the end of the striking motion by the striking tool. The workpiece 10 is then fixed in its shaping position on the gravure 17 by both handling devices 2 and 2' and held securely at both ends, up until and during the time that the striking tool strikes the workpiece 10. After the workpiece 10 is struck and released by the striking tool, the workpiece 10 is jointly and synchronously handled by both handling devices 2 and 2' according to the stored routine for further handling. The workpiece 10 is then ventilated, as already described with reference to FIG. 5, and then is either processed once again in the first gravure 17 or immediately transferred to the second gravure 18 in the tool 12. After the workpiece is transferred to the second gravure 18 a shaping step is carried out again, with actuation of the shaping machine and its striking tool at a variable point in time during or at the end of the handling motion between the first gravure 17 and the second gravure 18. After the striking motion is actuated, once again the further joint, synchronous handling of the workpiece 10 is initiated at an adjustable point in time during or at the end of the striking motion. The workpiece may now be jointly and synchronously ventilated again by both handling devices 2 and 2' in the second gravure 18 and, optionally, inserted once again into the gravure 18 for additional processing, or the workpiece 10 may be immediately transferred to the depositing device 42 for the finished, shaped workpiece 10.

Figure 8:
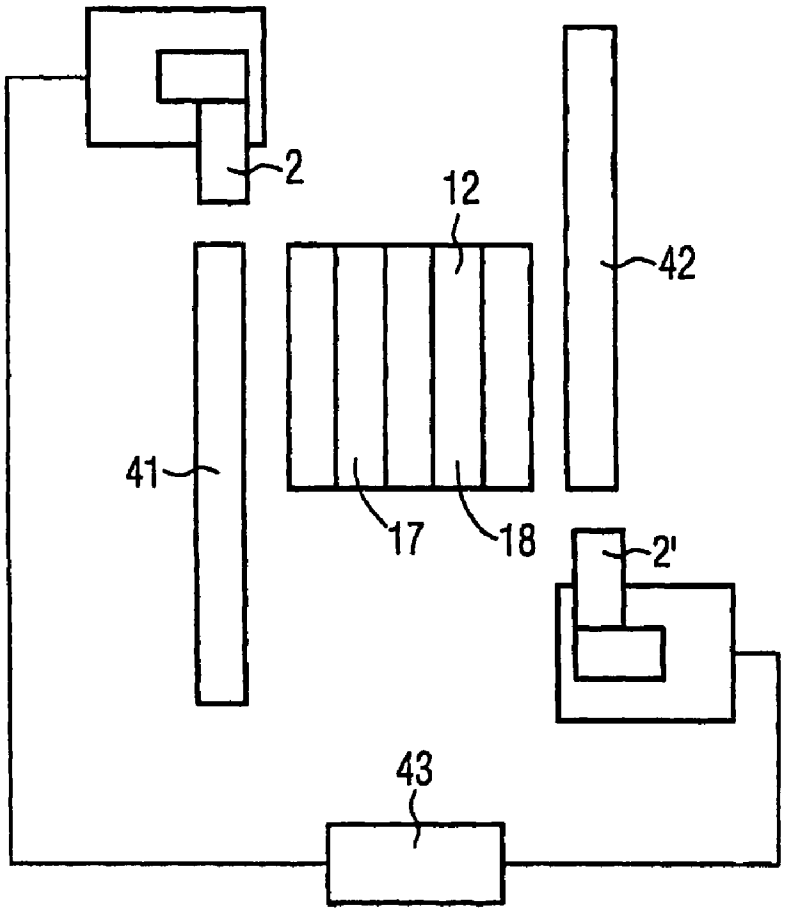
FIG. 8 shows a device for shaping a workpiece, having two handling devices in the parked position, in a top view, each in schematic representation. Corresponding variables and parts are provided with identical reference numbers in FIGS. 1 through 8.

FIG. 8 shows a parked or rest position of both handling devices 2 and 2' in a device according to FIG. 7. In the parked position of the handling devices it is possible to access the tools 12 and 13 of the shaping machine for replacing tools, reworking, or performing manual test operations on the percussive shaping machine.

The motion of the handling devices 2 and 2', and thus the handling motions for the workpiece 10, are generally learned. To this end, in a training process the workpiece 10 together with the two handling devices 2 and 2' is guided along the provided trajectory, optionally with rotational motions, and the individual spatial points or the corresponding motion parameters in the motion system of the handling devices 2 and 2' are stored at regular time intervals, typically 16 ms. In the exemplary embodiment of FIG. 6, for example, the trajectories S and S' of handling devices 2 and 2' are respectively [stored] in the form of discrete data sets, each being associated with a point on the trajectories, beginning with the path point S(t0) and S'(t0), through S(ti) or S'(ti) and S(tj) or S'(tj), to the endpoint S(tn) or S'(tn). For the subsequent process the motion is guided along the stored trajectories S and S'.

If the actual speed characteristic has already been established during the training process, the spatial points S(tm) or S'(tm) determined in the training process for $0 \leqq m \leqq n$ may be directly traversed by stepwise traversal from time t0 to time tn in the predetermined time intervals $\Delta = tm+1-tm$ of, for example, 16 ms. If the speed characteristic for the training process does not correspond to the actual subsequent speed characteristic, the path points stored during the training process are recalculated by corresponding transformation or imaging to the path points provided for the subsequent process. This type of training of robotic motions is known as such, and therefore does not require a detailed description.

Instead of guiding a reference workpiece during the training process using two handling devices 2 and 2', due to the mutually coordinated and generally synchronous motion of the handling devices 2 and 2' it is also possible for only the motion of one of the handling devices 2 or 2' to be learned, and the motion of the other handling device 2' or 2 to be adapted to the motion of the handling device which has been trained.

This may be achieved in particular by a master-slave operation, in which in particular the second, untrained handling device follows in a stepwise fashion the motions of the trained handling device.

Alternatively, for the parts of the handling motions in which both handling devices 2 and 2' are jointly and synchronously moved, as in the exemplary embodiment according to FIG. 6, for example, only one handling device, for example handling device 2, is trained, and the associated motion trajectory S or, in a more general sense, the associated motion sequence that can be characterized by translational and rotational motions, is stored. Then, by simple translational imaging via the translation vector Δ according to FIG. 6, the trajectory S' of the second handling device 2' is calculated. Thus, the handling devices 2 and 2' may have independent drive systems and control systems on the hardware side, yet be electrically or electronically coupled by mutually adapted control programs and sequences which permit the synchronous motions. Compared to a master-slave operation, this embodiment has the advantage that there is no longer any trailing distance between the two handling devices 2 and 2' as a result of the stepwise tracking, as is the case for master-slave operation, but instead the two handling devices 2 and 2' are located on mutually synchronous or parallel path points at any point in time tm.

In addition to the embodiments described with reference to FIGS. 1 through 4, other manipulators or industrial robots may also be used for the handling devices 2 and 2', in which preferably a good damping of the moving articulated joints and other motion mechanisms is provided to relieve the drives from recoil and vibrations from impact of the striking tool of the shaping machine. The aforementioned handling devices according to DE 42 20 796 A1 and DE 100 60 709 A1, for example, may also be used.

In addition to the described handling motions, as an addition or alternative thereto other handling motions may also be provided by handling devices 2 and 2', with or without the workpiece 10.

The distance between the gripping mechanisms, distance vector Δ in FIG. 6, for example, generally depends on the length, or the dimension measured along this distance, of the workpiece, and as a rule remains constant during the joint and synchronous handling.

However, a change in the volume or the shape of the workpiece after the shaping process, in particular a lengthening of the workpiece, may also be considered. This is achieved by changing the contact points of the handling devices 2 and 2' on the workpiece, such as by gripping farther out for a lengthening of the workpiece, for example. To this end, in particular the gripping pressure of gripping mechanisms 3 and 3' may be reduced, and—without releasing the workpiece or opening the gripping mechanisms 3 and 3'—the gripping mechanisms 3 and 3' of the handling devices 2 and 2' may be moved farther out along the workpiece 10.

In addition, the motion trajectories of both handling devices may also differ from one another in a mutually matched fashion, for example in an offset or correction, for example, if the workpieces have different ridges or some other different shape at the contact areas.

In a further embodiment, instead of a training process it is also possible to use an industrial robot having a motion characteristic that is controllable in a targeted manner inside an area accessible by the robot, in which the transformational description in the robot's three-dimensional coordinate system permits any given motion inside the area, without the motion previously having been made. This may be achieved in particular in a 3-D simulation.

The workpiece may also be rotated about a rotational axis, in particular by use of the embodiments of the handling devices described with reference to FIGS. 1 through 4. Of course, additional rotational motions or portions thereof are also possible in order to reach narrow areas on the transport path, for example.

The error communication via the control device illustrated in FIGS. 7 and 8 allows the process to be interrupted, in particular the handling devices to be stopped, when there is an impermissible deviation of one of the handling devices from the specified trajectory at a given point in time.

LIST OF REFERENCE NUMBERS

2, 2' Handling device
3, 3' Gripping mechanism
4, 4' Support shaft
5, 5' Support device
6, 6' Bearing part
7, 7° Flexible element
8, 8' Rotary drive
9, 9' Articulated joint
10 Workpiece
11, 11' Actuating device
12 Forging die
13 Striking tool
14, 14' Swivel bearing
15, 15' Lifting cylinder
16, 16° Conveying device
17, 18 Gravure
30, 31, 30', 31' Gripping jaw
32, 33, 32', 33' Gripping lever
34, 34' Swivel bearing
35, 35' Engagement bearing
41 Pickup device
42 Depositing device
43 Control device
50, 50' Support part
51, 52, 51', 52' Fastening part
53, 53' Connecting rod
54, 54' Support bearing
60, 60' Intermediate part
61, 61' Holding part
65, 65' Connecting flange
80, 80' Drive housing
87, 87' Drive flange
M Front axis
N Rear axis
A Impact direction
B, C Axis
D, E Swivel axis
F Swivel axis
G Gravitational force
R Rotational axis

The invention claimed is:

1. A method for shaping at least one workpiece, comprising:

positioning a work-piece between two associated tools in a predetermined shaping position in at least one working region of at least one shaping machine;

moving the two associated tools of the shaping machine relative to one another during at least one shaping step, such that the workpiece is shaped between the two associated tools;

holding the workpiece during each shaping step in its shaping position with at least two handling devices;

automatically controlling the motions and positions of the handling devices by mutual coordination with at least one control device;

wherein, for moving and/or handling the workpiece by the at least two handling devices, the control device actuates both at least two handling devices independently of one another.

2. A method according to claim 1, wherein the workpiece is shaped in at least two shaping steps.

3. A method according to claim 2, wherein the workpiece is shaped in at least two shaping steps in at least one of: the same working region, or the same shaping position.

4. A method according to claim 3, further comprising moving the workpiece:

from one working region to the next working region between two consecutive shaping steps with at least one handling device; or from one shaping position to the next shaping position, such that the workpiece is positioned in the next shaping position.

5. A method according to claim 3, further comprising rotating the workpiece between one shaping position and the next shaping position about a rotational angle of approximately 90°.

6. A method according to claim 1, further comprising, before the shaping step, conveying with at least one handling device from a pickup device each workpiece to the working region of the shaping machine.

7. A method according to claim 1, further comprising, after the shaping step, conveying each workpiece with at least one handling device from the working region of the shaping machine to a depositing device.

8. A method according to claim 1, wherein the workpiece is positioned by at least two handling devices in at least one of the shaping positions.

9. A method according to claim 8, further comprising, using the same two handling devices to position the workpiece in the shaping position, and to hold the workpiece during at least one shaping step.

10. A method according to claim 8, wherein the same two handling devices are used both to convey the workpiece from the pickup device to the working region, and to position the workpiece in the shaping position.

11. A method according to claim 8, wherein the same two handling devices are used both to position the workpiece in the shaping position, and to convey the workpiece from the working region of the shaping machine to a depositing device.

12. A method according to claim 8, further comprising using the same two handling devices to position the workpiece in each of the shaping positions, to hold the workpiece in each of the shaping positions, and to move the workpiece between the shaping positions.

13. A method according to claim 1, wherein the workpiece is one of:

positioned on one of the two associated tools of the shaping machine in its shaping position; or inserted on the tool in its shaping position.

14. A method according to claim 1, further comprising ventilating the workpiece from the two associated tools with the at least two handling devices upon at least one of:

after the workpiece is struck; or during a relative motion of the two associated tools away from one another.

15. A method according to claim 1, wherein the handling devices continuously grasp the workpiece during handling and movement thereof.

16. A method according to claim 1, wherein the workpiece, at least during each shaping step, is held on opposite sides or ends by a respective handling device.

17. A method according to claim 1, wherein during movement and/or handling of the workpiece by the at least two handling devices, contact points of the at least two handling devices are moved along trajectories $S(t_0)$ essentially at a constant distance with respect to one another.

18. A method according to claim 1, wherein during movement of the workpiece by at least two handling devices, contacts points of the handling devices are synchronously moved with respect to one another.

19. A method according to claim 1, further comprising moving contact points of the workpiece essentially at the same speed during movement of the workpiece by the at least two handling devices.

20. A method according to claim 1, wherein during handling of the workpiece by the at least two handling devices, the at least two handling devices pick up or release the workpiece essentially in a synchronous manner.

21. A method according to claim 1, wherein the respective at least two handling devices have at least one drive mechanism, each having at least one electric drive motor.

22. A method according to claim 1, wherein for moving and/or handling the workpiece by the at least two handling devices, the control device actuates both at least two handling devices, in particular the drive mechanisms thereof, according to a master-slave principle in which one of the at least two handling devices acts as the slave, thereby following the motions of the other of the at least two handling devices, which acts as the master.

23. A method according to claim 1, wherein at least a contact point of each of the at least two handling devices follows a trajectory determined in advance with a predetermined speed characteristic during movement and/or handling of the workpiece.

24. A method according to claim 1, wherein the at least two handling devices follows stored successive trajectory points at regular time intervals during movement and/or handling of the workpiece.

25. A method according to claim 24, further comprising learning the associated trajectory of the at least two handling device in advance.

26. A method according to claim 25, wherein the trajectory of one of the at least two handling devices or the corresponding contact points on the workpiece has been learned, and the trajectory of at least one additional at least two handling device or its contact point on the workpiece is calculated from the learned trajectory of the first at least two handling devices.

27. A method according to claim 25, wherein for learning the trajectory of the at least two handling devices or the corresponding contact point on the workpiece, the associated trajectory has been traversed at a predetermined speed characteristic, and the trajectory points have been successively determined and stored at regular time intervals.

28. A method according to claim 25, further comprising learning the trajectory by:

traversing the associated trajectory;

storing the trajectory points at regular time intervals; and calculating new trajectory points from a predetermined subsequent speed characteristic.

29. A method according to claim 28, wherein during the movement and/or handling of the workpiece, the at least two handling devices follow the trajectory points stored during learning.

30. A method according to claim 24, wherein the regular time intervals are between 1 ms and 50 ms.

31. A method according to claim 1, wherein the handling actions of the at least two handling devices are directly calculated in a three-dimensional coordinate system.

32. A method according to claim 1, further comprising:

checking whether the at least two handling device(s) maintain their motion and/or position predetermined by the control device; and stopping the motion of the at least two handling devices when there is an impermissible deviation.

33. A method according to claim 1, wherein a percussive shaping machine, including one of a forging hammer, a screw press, or a crank press, is provided as the shaping machine.

34. A method according to claim 1, wherein the at least two handling devices are moved into a parked position to make the working region of the shaping machine accessible.

35. A method according to claim 1, wherein the at least two handling devices are positioned on opposite sides of the working region of the shaping machine during one shaping step.

36. A method according to claim 1, wherein the at least two handling devices are industrial robots.

37. A method according to claim 1, wherein a deviation of the position of the workpiece relative to the associated tools as a consequence of the corresponding deviation of the shape of the workpiece is compensated in a region in which a first one of the handling devices grasps the workpiece, the compensation occurring by the two handling devices:

constraining the workpiece into the target position by fixing or gripping the workpiece at two points; and automatically aligning and inserting the workpiece into the associated tools in the correct shaping position.

38. A method according to claim 1, further comprising, after one of the associated tools have struck the workpiece, or after the associated tools have moved away from one another:

lifting the workpiece from the associated tools;

placing the workpiece again on the associated tools; and shaping the workpiece again with the associated tools.

39. A method according to claim 1, further comprising compensating for a change in the volume or shape of the workpiece after the shaping process by:

the at least two handling devices changing their corresponding contact points on the workpiece;

wherein the at least two handling devices change their contact points by one or both of:

reducing gripping pressure on the workpiece without releasing the workpiece; or contacting the workpiece at a more distal portion of the workpiece.

40. A method according to claim 1, wherein one or more trajectories of the motion of the at least two handling devices:

deviate from each other in a mutually-adapted manner; and present an offset or a compensating provision when the workpiece displays different ridges, or displays a different shape at one or more regions of contact.

41. A device for shaping at least one workpiece, comprising:

at least one shaping machine having at least two tools that are moveable with respect to one another for shaping a workpiece in a predetermined shaping position during at least one shaping step;

at least two handling devices for holding the workpiece in the shaping position during the shaping step; and at least one control device for controlling or regulating the motions and positions of the handling devices;

wherein:

the at least two handling devices are situated on opposite sides of the working region of the shaping machine at least when the workpiece is held during the shaping step; and each of the two handling devices comprises:

at least one gripping mechanism having at least two gripping elements that are movable relative to one another for gripping the workpiece; and at least one support apparatus to which the gripping mechanism is fastened.

42. A device according to claim 41, wherein:

a) in a flexible state, the support apparatus and the conveying device are connected to one another in a flexible manner; and b) in a rigid state, the support apparatus and the conveying device are at least one of:

i) connected to one another in a rigid manner; or ii) positioned relative to one another in a rigid manner in at least one three-dimensional direction, or in each rotational position of the gripping mechanism.

43. A device according to claim 41, wherein each handling device has at least one rotary drive for at least one of:

rotating the gripping mechanism about a rotational axis that extends through the gripping mechanism; and rotating at least one of the gripping elements about a rotational axis that extends through the gripping element.

44. A device according to one of claim 41, wherein the support apparatus and the conveying device are connected by at least one flexible element, wherein the support apparatus and the conveying device are connected only via the flexible element in the flexible state, and, in the rigid state, are supported on or against one another by at least one support device which bridges the flexible element.

45. A device according to one of claim 41, wherein the support apparatus and the conveying device are connected to one another by at least one connecting element that is flexible in the flexible state and rigid in the rigid state.

46. A device according to claim 44, wherein at least one rotary drive for rotating the gripping mechanism is situated on the side of:

i) the connecting element; or ii) the flexible element facing away from the gripping mechanism and the support apparatus.

47. A method for shaping at least one workpiece, comprising:

positioning a workpiece between two associated tools in a predetermined shaping position in at least one working region of at least one shaping machine;

moving the two associated tools of the shaping machine relative to one another during at least one shaping step, such that the workpiece is shaped between the two associated tools;

holding the workpiece during each shaping step in its shaping position with at least two handling devices;

automatically controlling the motions and positions of the at least two handling devices by mutual coordination with at least one control device, wherein the at least two handling devices follows stored successive trajectory points at regular time intervals during movement and/or handling of the workpiece; and learning the associated trajectory of the at least two handling device in advance.

48. A method according to claim 47, wherein the at least two handling devices are driven by at least one common drive mechanism having at least one electric drive motor, and are actuated by the control device by actuating the common drive mechanism.

49. A method for shaping at least one workpiece, comprising:

positioning a workpiece between two associated tools in a predetermined shaping position in at least one working region of at least one shaping machine;

moving the two associated tools of the shaping machine relative to one another during at least one shaping step, such that the workpiece is shaped between the two associated tools;

holding the workpiece during each shaping step in its shaping position with at least two handling devices;

automatically controlling the motions and positions of the at least two handling devices by mutual coordination with at least one control device, wherein the at least two handling devices follow stored successive trajectory points at regular time intervals during movement and/or handling of the workpiece; and learning the associated trajectory of the at least two handling device in advance;

wherein:

the trajectory of one of a the at least two handling devices or their the corresponding contact points on the workpiece has been learned; and the trajectory of at least one additional at least two handling device or its contact point on the workpiece has been calculated from the learned trajectory of the first at least two handling devices.

50. A method for shaping at least one workpiece, comprising:

positioning a workpiece between two associated tools in a predetermined shaping position in at least one working region of at least one shaping machine;

moving the two associated tools of the shaping machine relative to one another during at least one shaping step, such that the workpiece is shaped between the two associated tools;

holding the workpiece during each shaping step in its shaping position with at least two handling devices;

automatically controlling the motions and positions of the at least two handling devices by mutual coordination with at least one control device, wherein the at least two handling devices follow stored successive trajectory points at regular time intervals during movement and/or handling of the workpiece; and learning the associated trajectory of the at least two handling device in advance;

wherein, for learning the trajectory of the at least two handling devices or the corresponding contact point on the workpiece:

the associated trajectory has been traversed at a predetermined speed characteristic; and the trajectory points have been successively determined and stored at regular time intervals.

51. A method for shaping at least one workpiece, comprising:

positioning a workpiece between two associated tools in a predetermined shaping position in at least one working region of at least one shaping machine;

moving the two associated tools of the shaping machine relative to one another during at least one shaping step, such that the workpiece is shaped between the two associated tools;

holding the workpiece during each shaping step in its shaping position with at least two handling devices;

automatically controlling the motions and positions of the at least two handling devices by mutual coordination with at least one control device, wherein the at least two handling devices follow stored successive trajectory points at regular time intervals during movement and/or handling of the workpiece; and learning the associated trajectory of the at least two handling devices in advance by:

traversing the associated trajectory;

storing the trajectory points at regular time intervals; and calculating new trajectory points from a predetermined subsequent speed characteristic.

52. A method for shaping at least one workpiece, comprising:

positioning a workpiece between two associated tools in a predetermined shaping position in at least one working region of at least one shaping machine;

moving the two associated tools of the shaping machine relative to one another during at least one shaping step, such that the workpiece is shaped between the two associated tools;

holding the workpiece during each shaping step in its shaping position with at least two handling devices;

automatically controlling the motions and positions of the at least two handling devices by mutual coordination with at least one control device, wherein the at least two handling devices follow stored successive trajectory points at regular time intervals during movement and/or handling of the workpiece; and learning the associated trajectory of the at least two handling devices in advance by:

traversing the associated trajectory;

storing the trajectory points at regular time intervals; and calculating new trajectory points from a predetermined subsequent speed characteristic;

wherein, during the movement and/or handling of the workpiece, the at least two handling devices follow the trajectory points stored during learning.

53. A method for shaping at least one workpiece, comprising:

positioning a workpiece between two associated tools in a predetermined shaping position in at least one working region of at least one shaping machine;

moving the two associated tools of the shaping machine relative to one another during at least one shaping step, such that the workpiece is shaped between the two associated tools;

holding the workpiece during each shaping step in its shaping position with at least two handling devices;

automatically controlling the motions and positions of the at least two handling devices by mutual coordination with at least one control device;

wherein:

the at least two handling devices follow stored successive trajectory points at regular time intervals during movement and/or handling of the workpiece; and the regular time intervals are between 1 ms and 50 ms.

54. A device for shaping at least one workpiece, comprising:

at least one shaping machine having at least two tools that are moveable with respect to one another for shaping a workpiece in a predetermined shaping position during at least one shaping step;

at least two handling devices for holding the workpiece in the shaping position during the shaping step; and at least one control device for controlling or regulating the motions and positions of the handling devices;

wherein:

the at least two handling devices are situated on opposite sides of the working region of the shaping machine at least when the workpiece is held during the shaping step; and each of the two handling devices comprises:

at least one gripping mechanism having at least two gripping elements that are movable relative to one another for gripping the workpiece; and at least one support apparatus to which the gripping mechanism is fastened;

wherein:

in a flexible state, the support apparatus and the conveying device are connected to one another in a flexible manner; and in a rigid state, the support apparatus and the conveying device are at least one of:

connected to one another in a rigid manner; or positioned relative to one another in a rigid manner in at least one three-dimensional direction, or in each rotational position of the gripping mechanism.

55. A device for shaping at least one workpiece, comprising:

at least one shaping machine having at least two tools that are moveable with respect to one another for shaping a workpiece in a predetermined shaping position during at least one shaping step;

at least two handling devices for holding the workpiece in the shaping position during the shaping step; and at least one control device for controlling or regulating the motions and positions of the handling devices;

wherein:

the at least two handling devices are situated on opposite sides of the working region of the shaping machine at least when the workpiece is held during the shaping step; and each of the two handling devices comprises:

at least one gripping mechanism having at least two gripping elements that are movable relative to one another for gripping the workpiece; and at least one support apparatus to which the gripping mechanism is fastened;

wherein each handling device has at least one rotary drive for at least one of:

rotating the gripping mechanism about a rotational axis that extends through the gripping mechanism; and rotating at least one of the gripping elements about a rotational axis that extends through the gripping element.

56. A device for shaping at least one workpiece, comprising:

at least one shaping machine having at least two tools that are moveable with respect to one another for shaping a workpiece in a predetermined shaping position during at least one shaping step;

at least two handling devices for holding the workpiece in the shaping position during the shaping step; and at least one control device for controlling or regulating the motions and positions of the handling devices;

wherein:

the at least two handling devices are situated on opposite sides of the working region of the shaping machine at least when the workpiece is held during the shaping step; and each of the two handling devices comprises:

at least one gripping mechanism having at least two gripping elements that are movable relative to one another for gripping the workpiece; and at least one support apparatus to which the gripping mechanism is fastened;

wherein:

the support apparatus and the conveying device are connected by at least one flexible element;

the support apparatus and the conveying device are connected only via the flexible element in the flexible state, and, in the rigid state, are supported on or against one another by at least one support device which bridges the flexible element.

57. A device for shaping at least one workpiece, comprising:

at least one shaping machine having at least two tools that are moveable with respect to one another for shaping a workpiece in a predetermined shaping position during at least one shaping step;

at least two handling devices for holding the workpiece in the shaping position during the shaping step; and at least one control device for controlling or regulating the motions and positions of the handling devices;

wherein:

the at least two handling devices are situated on opposite sides of the working region of the shaping machine at least when the workpiece is held during the shaping step; and each of the two handling devices comprises:

at least one gripping mechanism having at least two gripping elements that are movable relative to one another for gripping the workpiece; and at least one support apparatus to which the gripping mechanism is fastened;

wherein the support apparatus and the conveying device are connected to one another by at least one connecting element that is flexible in the flexible state and rigid in the rigid state.

58. A device for shaping at least one workpiece, comprising:

at least one shaping machine having at least two tools that are moveable with respect to one another for shaping a workpiece in a predetermined shaping position during at least one shaping step;

at least two handling devices for holding the workpiece in the shaping position during the shaping step; and at least one control device for controlling or regulating the motions and positions of the handling devices;

wherein:

the at least two handling devices are situated on opposite sides of the working region of the shaping machine at least when the workpiece is held during the shaping step; and each of the two handling devices comprises:

at least one gripping mechanism having at least two gripping elements that are movable relative to one another for gripping the workpiece; and at least one support apparatus to which the gripping mechanism is fastened;

wherein:

the support apparatus and the conveying device are connected to one another by at least one connecting element that is flexible in the flexible state and rigid in the rigid state; and at least one rotary drive for rotating the gripping mechanism is situated on the side of:

the connecting element; or the flexible element facing away from the gripping mechanism and the support apparatus.

* * * * *

UNITED STATES PATENT AND TRADEMARK OFFICE

CERTIFICATE OF CORRECTION

PATENT NO. : 7,350,389 B2
APPLICATION NO. : 10/559046
DATED : April 1, 2008
INVENTOR(S) : Reissenweber et al.

It is certified that error appears in the above-identified patent and that said Letters Patent is hereby corrected as shown below:

Column 8
Line 55, change “inclination a” to --inclination--
Line 63, change “angle α or α',” to --the angle,--

Column 12
Line 33, change “Δ=tm+1-tm” to --Δt=tm+1-tm--

Signed and Sealed this

Third Day of February, 2009

JOHN DOLL
*Acting Director of the United States Patent and Trademark Office*